US005415981A

United States Patent [19]

Clarke et al.

[11] Patent Number: 5,415,981

[45] Date of Patent: May 16, 1995

[54] PHOTOGRAPHIC SILVER HALIDE COLOR MATERIALS

[75] Inventors: David Clarke, Watford; Paul L. Stanley, Harrow, both of United Kingdom

[73] Assignee: Eastman Kodak Company, Rochester, N.Y.

[21] Appl. No.: 26,331

[22] Filed: Mar. 4, 1993

[30] Foreign Application Priority Data

Mar. 31, 1992 [GB] United Kingdom ..... 9206972
Apr. 21, 1992 [GB] United Kingdom ..... 9208616

[51] Int. Cl.[6] ..... G03C 1/42; G03C 5/00

[52] U.S. Cl. ..... 430/384; 430/435; 430/546; 430/558

[58] Field of Search ..... 430/264, 546, 558, 598, 430/384, 435

[56] References Cited

U.S. PATENT DOCUMENTS

| | | | |
|---|---|---|---|
| 2,424,256 | 7/1947 | Schmidt et al. | 95/88 |
| 3,782,949 | 1/1974 | Olivares et al. | 96/76 R |
| 4,481,268 | 11/1984 | Bailey et al. | 430/17 |
| 4,619,884 | 10/1986 | Singer | 430/223 |
| 4,923,783 | 5/1990 | Kobayashi et al. | 430/377 |
| 5,006,445 | 4/1991 | Yagihara et al. | 430/264 |
| 5,044,675 | 4/1991 | Yoneyama et al. | 430/377 |
| 5,100,761 | 3/1992 | Yagihara et al. | 430/264 |
| 5,104,783 | 4/1992 | Shimada et al. | 430/558 |
| 5,110,714 | 5/1992 | Furusawa et al. | 430/505 |
| 5,147,764 | 9/1992 | Bowne | 430/372 |
| 5,162,196 | 11/1992 | Sato et al. | 430/558 |
| 5,185,241 | 2/1993 | Inoue | 430/598 |
| 5,227,287 | 7/1993 | Sato et al. | 430/558 |

FOREIGN PATENT DOCUMENTS

| | | |
|---|---|---|
| 0254294 | 1/1988 | European Pat. Off. . |
| 0362808 | 4/1990 | European Pat. Off. . |
| 0488109 | 6/1992 | European Pat. Off. . |
| 2128800 | 10/1972 | France . |
| 02108043 | 4/1990 | Japan . |
| 83/00939 | 3/1983 | WIPO . |

*Primary Examiner*—Janet C. Baxter
*Attorney, Agent, or Firm*—Gordon M. Stewart

[57] ABSTRACT

A method of forming a photographic colour image which comprises imagewise exposing a photographic silver halide colour material and processing it with an alkaline developer solution in the presence of a sulphonhydrazide developer and a heteroarylacetonitrile colour coupler thus forming a dye image by reaction of oxidised colour developing agent and the colour coupler. A colour photographic material is also provided having at least two colour-forming units sensitive to different regions of the spectrum, each having a silver halide emulsion layer, characterised in that the material contains in or adjacent said layer, a ballasted photographic colour coupler and a ballasted sulphonhydrazide colour developing agent incorporated therein in droplets of a high boiling solvent and in which the colour coupler is a heteroarylacetonitrile.

10 Claims, No Drawings

PHOTOGRAPHIC SILVER HALIDE COLOR MATERIALS

FIELD OF THE INVENTION

The present invention relates to processes for the formation of photographic colour images in photographic silver halide colour materials.

BACKGROUND OF THE INVENTION

Existing commercial photographic silver halide colour materials form dye images by the reaction of oxidised p-phenylenediamine colour developers with a colour coupler. The colour developing solutions employed contain the colour developing agent and used developer solutions need to be disposed of safely. Attempts have been made to incorporate p-phenylenediamine colour developing agents into silver halide photographic materials but these have had little success largely due to the pronounced staining produced.

The use of sulphonhydrazides as colour developers in aqueous colour developer solutions which form an azo dye on coupling with a colour coupler are described in U.S. Pat. Nos. 2,424,256, 4,481,268 and copending British Application No. 9125688.3.

A problem encountered with this system is that it is difficult to obtain the desired hue for the cyan image.

SUMMARY OF THE INVENTION

The present invention provides a process in which a class of couplers are used with sulphonhydrazide colour developers to form image dyes of desirable cyan hue.

According to the present invention there is provided a method of forming a photographic colour image which comprises imagewise exposing a photographic silver halide colour material and processing it with an alkaline processing solution in the presence of a sulphonhydrazide developer and a heteroarylacetonitrile colour coupler thus forming a dye image by reaction of oxidised colour developing agent and the colour coupler.

Advantages of the present invention include being able to photographically generate image dyes of desirable cyan dyes without the use of p-phenylenediamine developers and allowing both the coupler and the colour developer to be incorporated in the photographic material.

The present invention further provides a colour photographic material comprising at least two colour-forming units sensitive to different regions of the spectrum each comprising a silver halide emulsion layer characterised in that the material contains in or adjacent said layer, a ballasted photographic colour coupler and a ballasted sulphonhydrazide colour developing agent incorporated therein in droplets of a high boiling solvent and wherein the colour coupler is a heteroarylacetonitrile.

EMBODIMENTS OF THE INVENTION

In a preferred embodiment the invention provides a colour photographic material in which the material is a multicolour photographic material comprising a support bearing a yellow dye image-forming unit comprised of at least one blue-sensitive silver halide emulsion layer having associated therewith at least one yellow azo dye-forming coupler, at least one magenta dye image-forming unit comprising at least one green-sensitive silver halide emulsion layer having associated therewith at least one magenta dye-forming coupler at least one cyan dye image-forming unit comprising at least one red-sensitive silver halide emulsion layer having associated therewith at least one cyan dye-forming coupler.

The sulphonhydrazide colour developing agent may have the formula:

$$R—NHNH—SO_2—R^1 \quad (1)$$

wherein R is an aryl or heterocyclic group which may be substituted, and $R^1$ is an alkyl or aryl group, either of which may be substituted, and wherein R or $R^1$ contains a ballasting group of such size and configuration as to render the compound non-diffusible.

A preferred group of developing agents of formula (1) are those in which R is a heterocyclic group.

The heteroarylacetonitrile colour coupler preferably has the formula:

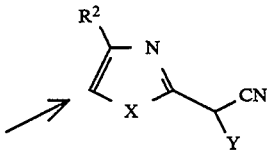

(2)

wherein $R^2$ is H or an alkyl, aryl or heterocyclic group any of which may be substituted, X is —S—, —O— or —N($R^3$)— where $R^3$ is alkyl or aryl group either of which may be substituted, Y is an electron-withdrawing group having a Hammett sigma-para value greater than 0.3, and wherein the coupling position is indicated by the arrow.

Examples of groups $R^2$ are: methyl, ethyl, t-butyl, octadecyl, —$CF_3$, —$CH_2COOEt$, benzyl, phenyl, thienyl, furanyl, ball—$SO_2NH$—Ph, ball—CONH—Ph, ball—$NHSO_2$—Ph, ball—HCO—Ph, $R^4CONH$—, $R^4NHCO$—, $R^4SO_2NH$—, $R^4NHSO_2$— and —COO—alkyl wherein ball is a ballast group and $R^4$ is an alkyl or aryl group and Ph is phenyl.

Examples of groups Y are: —$CONH_2$, —CONH—$R^4$, —COO—$R^4$, —$COR^4$, —CN, —$SO_2NH_2$, —$SO_2NHR^4$, —$SO_2$—$R^4$, —$SO_2CF_3$ and —$NO_2$.

Examples of groups $R^3$ are methyl, ethyl, t-butyl, octadecyl, —$CF_3$, —$CH_2COOEt$, hydhroxyethyl, benzyl, phenyl, tolyl, chlorophenyls, bromophenyls.

The coupler and the colour developer may be incorporated in the photographic silver halide material or the developer. If incorporated in the material, the compound should have a ballasting group of such size and configuration to render it non-diffusible in the photographic material or be in the form of a polymeric coupler.

The ballast group may be attached to couplers of formula (2) by forming part of either the Y or the $R^2$ group. The ballast group in the sulponhydrazides of formula (1) may be attached by forming part of either $R^4$ or $R^1$.

As is conventional with colour couplers, the coupler and the developing agent may be incorporated in the photographic material in droplets of high boiling coupler solvent. The high boiling solvent used to incorporate the coupler and/or colour developer in the photographic material may be any solvent known as a coupler solvent (and used for incorporating couplers into photographic materials). Many such solvents are listed in Research Disclosure Item 308119, December 1989 published by Kenneth Mason Publications, Emsworth, Hants, United Kingdom. The coupler and colour developer may be incorporated in the same or different droplets of coupler solvent.

Examples of heteroaryl-acetonitrile couplers of formula (2) are listed in the following table:

TABLE 1

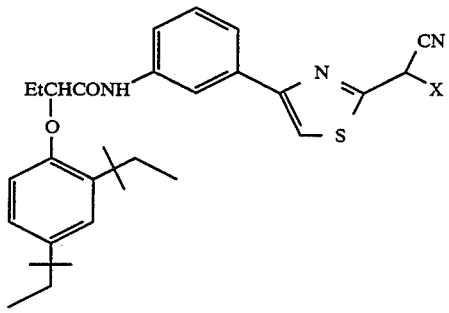

X = COOEt (C-1)
X = CN (C-2)
X = COMe (C-3)

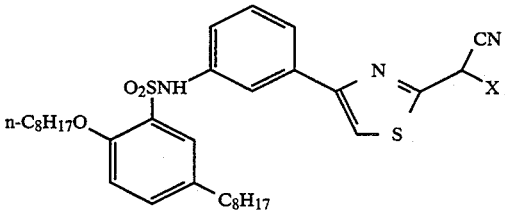

X = CN (C-4)
X = COOEt (C-5)

(C-6)

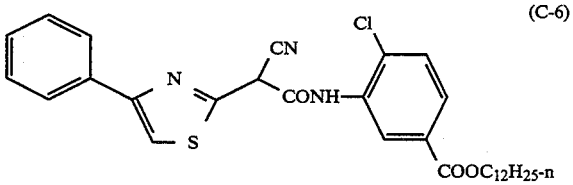

(C-7)

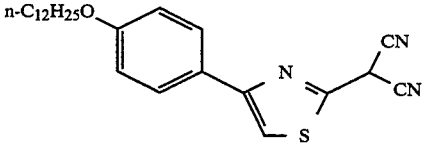

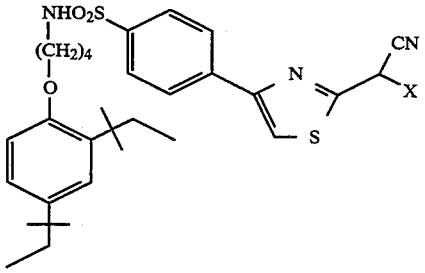

X = CN (C-8)
X = COOEt (C-9)

TABLE 1-continued (C-10)

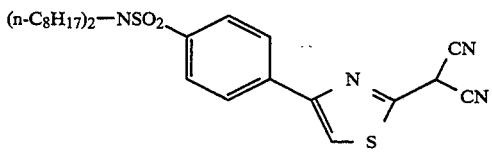

(C-11)

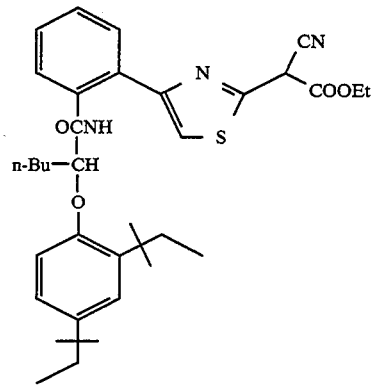

(C-12)

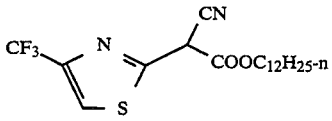

(C-13)

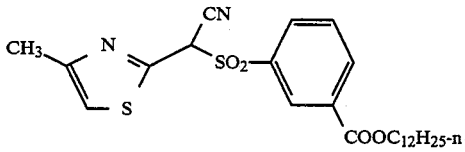

(C-14)

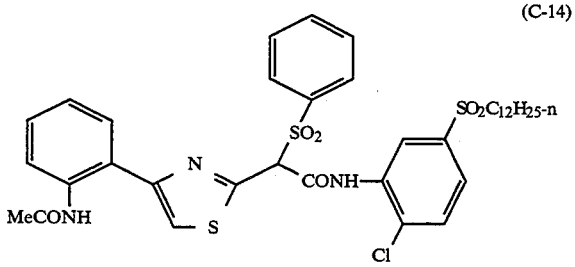

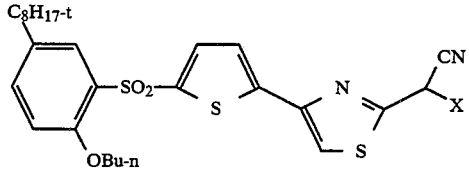

X = CN (C-15)
X = COOEt (C-16)

(C-17)

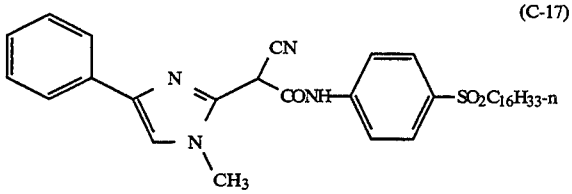

TABLE 1-continued (C-18)

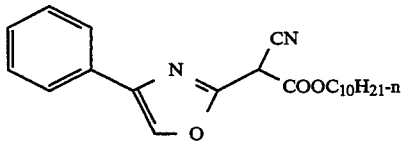

(C-19)

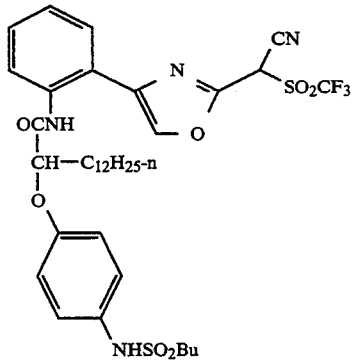

(C-20)

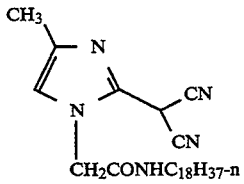

The heterocyclic acetonitrile couplers used in the present invention may be prepared as described in U.S. Pat. No. 4,371,734 wherein the compounds are used as textile dye intermediates.

Many examples of suitable sulphonhydrazide colour developers are listed in our copending British application 9125688.3 Specific examples include the following:

(D1)

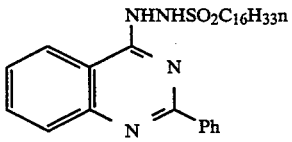

(D2)

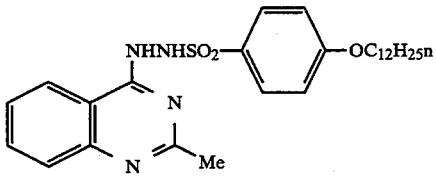

(D3)

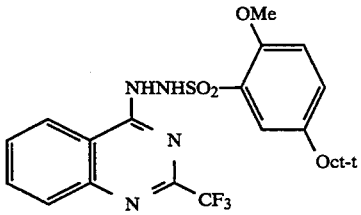

-continued (D4)

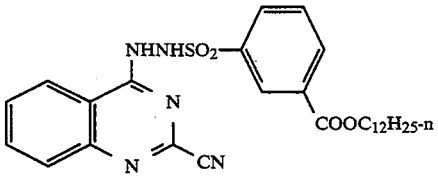

(D5)

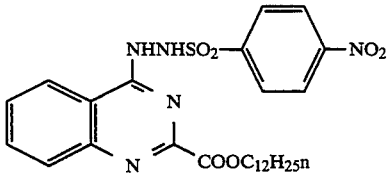

(D6)

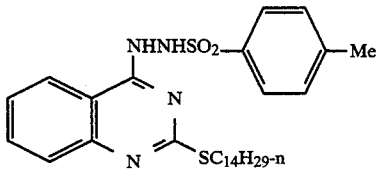

(D7)

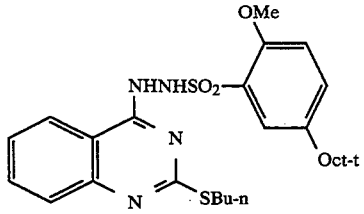

(D8)

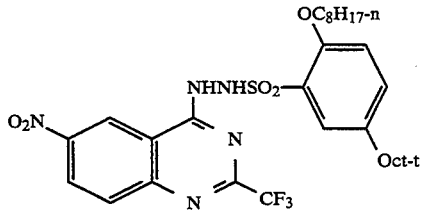

(D9)

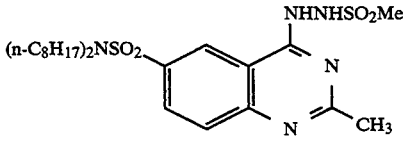

(D10)

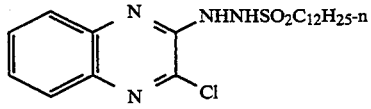

(D11)

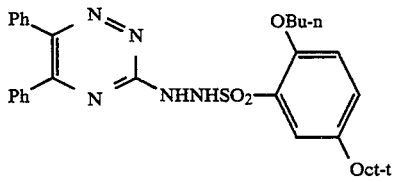

The present photographic materials, after imagewise exposure, may be processed by treatment in an alkaline solution. In such a process oxidised colour developer forms in areas of silver halide development and the oxidised form of the developer couples with the coupler to form image dye.

In a preferred embodiment, the alkaline solution contains an electron transfer agent (ETA), for example a pyrazolidinone. A specific ETA that may be used is 4-hydroxymethyl-4-methyl-1-phenylpyrazolidin-3-one.

Couplers of the present invention may by synthesised by a modification of the method described in U.S. Pat. No. 4,481,268. Representative preparations are given below for couplers C-1, C-3 and C-4.

Preparative Example 1: Synthesis of Coupler C-1

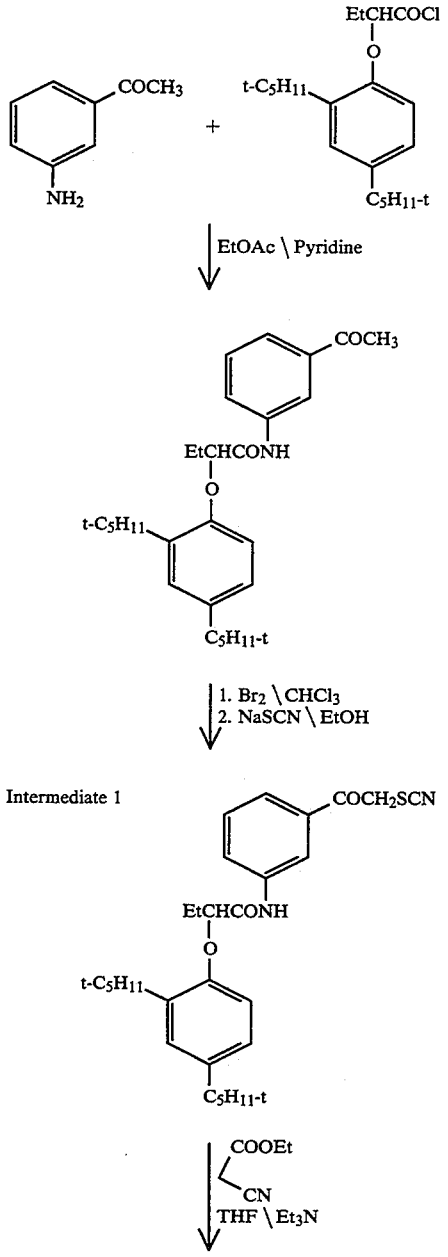

-continued

Intermediate 2

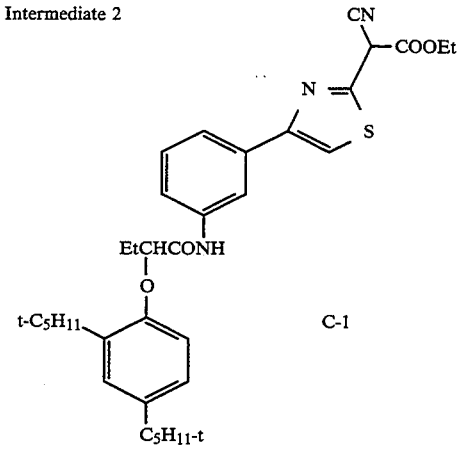

C-1

Intermediate 1

A freshly prepared solution of 2-(2,4-di-t-pentylphenoxy)butyryl chloride (27.0 g, 0.08 mole) in ethyl acetate (100 ml) was added dropwise to a solution of 3-amino-acetophenone (10.8 g, 0.08 mole) in ethyl acetate (200 ml) and pyridine (7 ml). After stirring for 1 h. at room temperature, the solution was extracted with 1M hydrochloric acid (200 ml). The organic layer was separated, washed with water, then dried over magnesium sulphate and filtered. Removal of solvent gave the crude product which was purified by silica gel column chromatography, eluting with 4:1 60–80 petrolethyl acetate mixture. The intermediate 1 was isolated as a straw-coloured viscous oil, 28.0 g (80%).

MS gave MH+ at 438 m/z. NMR and IR spectra were consistent with the desired structure.

$C_{20}H_{39}NO_3$ Req: C, 76.9; H, 8.9; N, 3.2% Fd: C, 76.5; H, 8.4; N, 3.2%.

Intermediate 2 (α-thiocyanato-ketone)

The 3-substituted acetophenone intermediate 1 (28.0 g, 0.064 mole) was dissolved in chloroform (300 ml) and stirred while bromine (3.4 ml, 0.064 mole) in chloroform (25 ml) was dripped in over 0.5 h. (Gentle heating on a steam bath was sufficient to initiate the bromination reaction which was continued at ambient temperature). After stirring a further 1 h, the pale yellow solution was washed (x2) with sodium hydrogen carbonate solution. The chloroform layer was separated, dried over $MgSO_4$, then solvent removed in vacuo to give the crude a-bromoketone as an oil (33 g). (Tlc in 4:1 petrol-ethyl acetate revealed the presence of some remaining starting material plus di-brominated ketone, in addition to the desired product).

The crude bromoketone (33 g) was taken up in ethanol (150 ml) and stirred vigorously while excess sodium thiocyanate (7.0 g) was added in one charge. After 1 h. at room temperature, inorganic material was filtered off and the ethanolic liltrate evaporated to dryness under reduced pressure. The residue was taken up in ethyl acetate (250 ml), washed (x2) with water and dried ($MgSO_4$). Removal of solvent gave an oil which was eluted down a silica column in 6:1 petrol-ethyl acetate to give the desired intermediate 2 as a pale yellow oil which did not crystallise on standing. Yield=16.0 g, (51% overall from intermediate 1).

MS gave MH+ at 495 m/z.

The compound was further characterised by IR and NMR.

Coupler C-1

Intermediate 2 (20.0 g, 0.04 mole) was dissolved in ethanol (100 ml) and stirred at room temperature while ethyl cyanoacetate (4.6 g, 0.04 mole) was added followed by tri-ethylamine (10 ml, 0.08 mole). The resulting reddish-brown solution was stirred for 3 h., then solvent removed under reduced pressure. The residual oil was extracted into ethyl acetate (200 ml) and washed successively with 0.1M hydrochloric acid then water. After drying over magnesium sulphate, solvent was removed and the crude product purified by silica gel column chromatography eluting with 3:1 petrol-ethyl acetate. The coupler C-1 was isolated as a pale yellow solid 8.0 g, (34%), mp 152°-3° C.

$C_{34}H_{43}N_3O_4S$ Req: C, 69.2; H, 7.3; N, 7.1; S, 5.4% Fd: C, 68.8: H, 7.4; N, 7.0; S, 5.2%. MS gave M+ at 590 m/z. IR and NMR were also consistent.

Preparative Example 2: Synthesis of Coupler C-3

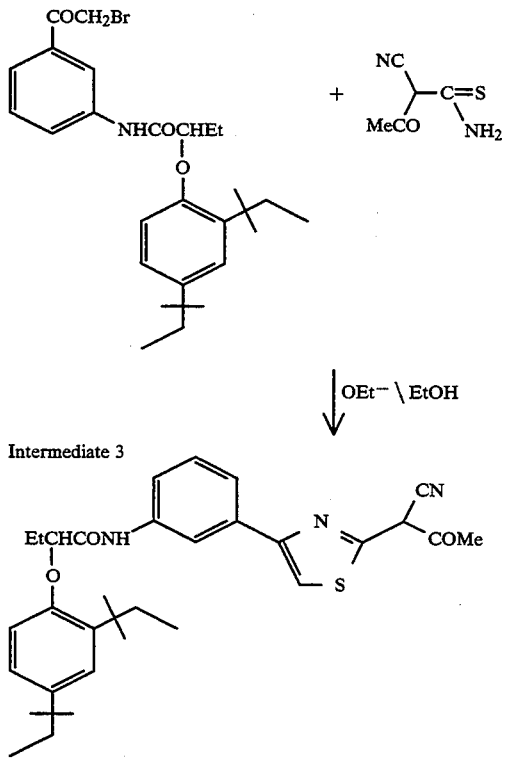

The α-bromoketone intermediate 3 was prepared as described in Preparative Example 1. A solution of this ketone (26.0 g, 0.05 mole) and α-acetyl-α-cyanothioacetamide (7.1 g, 0.05 mole) in ethanol (200 ml) was stirred at room temperature with sodium ethoxide (0.05 mole). After 0.5 h, solvent was removed under reduced pressure and the residue extracted into ethyl acetate (200 ml). The organic solution was washed successively with dilute hydrochloric acid and water then dried over $MgSO_4$. After solvent removal, the crude product was eluted down a silica column in 2:1 petrol-ethyl acetate to obtain Coupler C3 as a white solid, 7.5 g (27%), mp 124°-125° C.

$C_{33}H_{41}N_3S$ Req: C, 70.8; H, 7.4; N, 7.0; S, 5.7% Fd: C, 69.7; H, 7.4; N, 7.0; S, 5.3% The coupler structure was confirmed by MS, IR and NMR.

Preparative Example 3: Synthesis of Coupler C-4

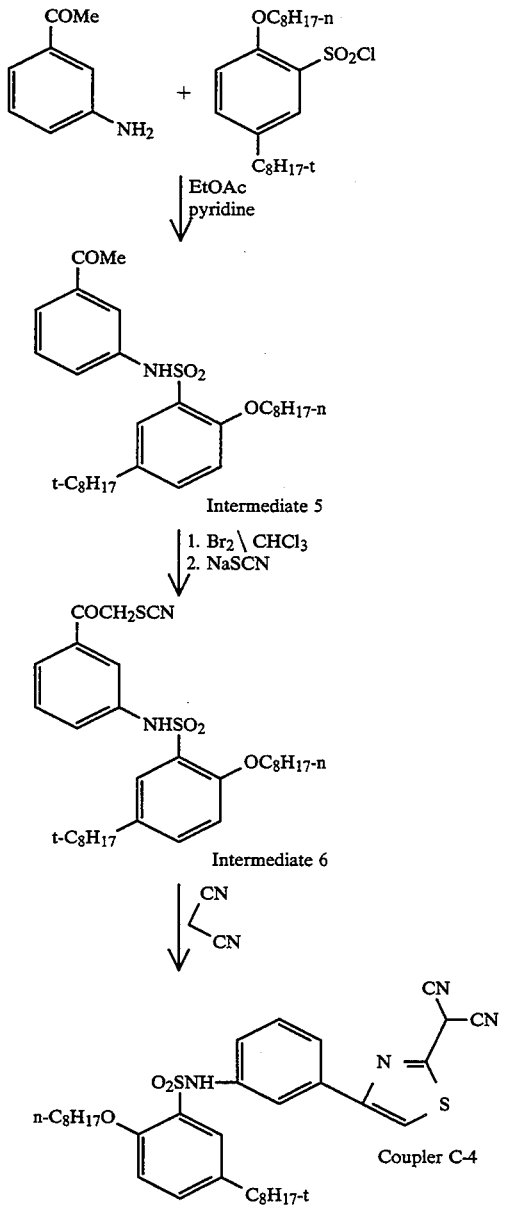

Intermediate 5

Following the procedure described in Preparative Example 1, 3-aminoacetophenone (7.5 g, 0.05 mole) and 2-n-octyl-5-t-octylbenzenesulphonyl chloride (25.5 g, 0.06 mole) were reacted to give intermediate 5 as a white solid, 18.0 g (58%).

C30H45NO4S Req: C, 69.9; H, 8.8; N, 2.7; S, 6.2% Fd: C, 69.7; H, 9.2; N, 2.7; S, 5.9% MS gave M+ at 515m/z.

Intermediate 6

Bromination of intermediate 5 (17.0 g, 0.033 mole) using the method shown in Preparative Example 1, followed by reaction with ethanolic sodium thiocyanate gave the crude α-thiocyanato-ketone (intermediate 6). This was purified by colum chromatography in 5:1 petrol-ethyl acetate to give product as a pale yellow oil which slowly crystallised on standing, 12.8 (68% overall).

The correct structure was confirmed by IR, NMR and MS (gave M+ at 572 m/z).

Coupler C-4

Intermediate 6 (26.6 g, 0.045 mole) was taken up in ethanol (150 ml) and stirred with malononitrile (3.0 g, 0.045 mole) and tri-ethylamine (9.0 g, 0.09 mole). After 3 h the solvlent was evaporated and the residue extracted into ethyl acetate (200 ml). The extract was washed with dilute hydrochloric acid then water. After drying over magnesium sulphate, solvent was again removed under reduced pressure to give the crude coupler. Recrystallisation (x2) from a 60/80 petrol-ethyl acetate mixture, gave Coupler C-4 as white solid 8.4 g, (30%).

$C_{31}H_{44}N_{403}S_2$ Req: C, 65.8; H, 7.1; N, 9.0; S, 10.3% Fd: C, 65.5: H, 7.1; N, 8.8; S, 9.7%. The correct structure was confirmed by IR, NMR and MS (gave M+ at 620 m/z).

The sulphonhydrazide developer compounds may be prepared by the following scheme or analogous methods:

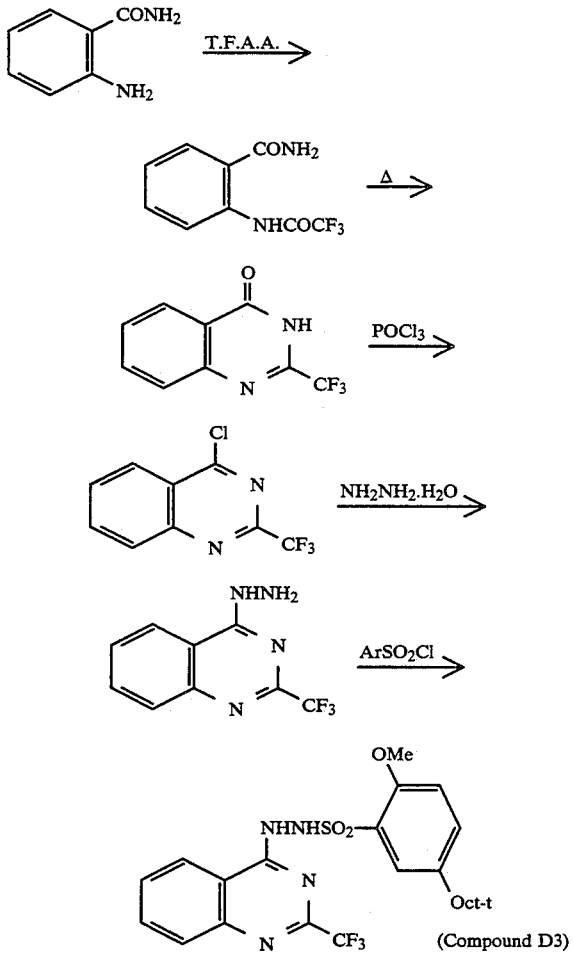

A specific preparation is described below.

Preparative Example 4

(Trifluoroacetamido)benzamide

2-Aminobenzamide (70.0 g, 0.52 mole) was dissolved in THF (300 ml) and cooled in an ice-bath. Trifluoroacetic anhydride (72.8 ml, 0.52 mole) was added dropwise with stirring over a period of one hour. After stirring a further 2 hours, the white suspension which had formed was poured onto ice-water (11). The white precipitate was collected by filtration and air dried. Yield of product was 73.5 g (62%).

Found: C, 46.8; H, 3.3; N, 12.1% $C_9H_7F_3N_2O_2$ Requires: C, 46.6; H, 3.0; N, 12.1%

2-Trifluoromethyl-4-quinazolinone (Trifluoroacetamido)benzamide (73.0 g, 0.31 mole) was heated in ethylene glycol (150 ml) in an oil bath with stirring. The amide dissolved at around 130° and product began to precipitate out at 150°. The temperature was held at 150° for a further 1 hour before cooling. The solid was filtered off washing well with cold water to give the product, 55.7 g (84%).

Found: C, 50.4; H, 2.6; F, 26.4; N, 13.0% $C_9H_5F_3N_2O$ Requires: C, 50.5; H, 2.4, F, 26.6; N, 13.1%

4-Chloro-2-trifluoromethylquinazoline

2-Trifluoromethyl-4-quinazoline (24.0 g, 0.11 mole) was refluxed in phosphoryl chloride (120 ml) using an oil bath. After 1.5 h, the solution was cooled and excess phosphoryl chloride removed in vacuo. The crude product was extracted in ethyl acetate (200 ml) and washed successively with sodium bicarbonate solution then water. After drying the organic solution, removal of solvent gave an oil which was eluted down a silica gel chromatography column with dichloromethane. The product was collected as a colourless oil which rapidly crystallised. Yield is 25.4 g (91%).

Found: C, 46.5; H, 1.9; F, 24.1; N, 12.0% $C_9H_4C_1F_3N_2$ Requires: C, 46.5; H, 1.7; F, 24.5; N, 12.0%

4-Hydrazino-2-trifluoromethylquinazoline

4-Chloro-2-trifluoromethylquinazoline (46.4 g, 0.2 mole) was taken up in ethanol (500 ml). Hydrazine hydrate (20 ml, 0.4 mole) was added and the contents refluxed for 2 hours. On cooling, the yellow precipitate was filtered and slurried in water (500 ml) to removed hydrazine hydrochloride. Filtration gave the product as a yellow crystalline solid, 34.5 g (76%).

Found: C, 47.3; H, 3.2; F, 24.6; N, 24.7% $C_9H_7F_3N_4$ Requires: C, 47.4; H, 3.1; F, 25.0; N, 24.5%

Compound 3

4-Hydrazino-2-trifluoromethylquinazoline (32.4 g, 0.14 mole) was taken up in DMF (250 ml) and triethylamine (30 ml, 0.21 mole). A solution of 2-methoxy-5-t-octyl-benzenesulphonyl chloride (45.2 g, 0.14 mole) in THF (50 ml) was added dropwise with stirring at temperature over 0.5 hours, then the mixture stirred a further 2 hours. A small amount of white solid (triethylamine hydrochloride) was filtered off and discarded while the liltrate was evaporated to dryness under vacuum. The resulting dark brown oil was purified by column chromatography eluting with 3:1 (v/v) 60–80 petrol-/ethyl acetate. The product was collected and solvent removed to give a cream coloured solid, 29.7 g (41%), mp 186°–189°. Mass spec showed M+ at 510 m/e HPLC gave a purity of 100%

$C_{24}H_{29}F_3N_4O_3S$Requires: C, 56.1; H, 5.7; F, 11.2; 11.0; S, 6.3% Found: C 56.4; H, 5.7; F, 11.5; N, 10.7; S, 6.3%

In the following example, the testing was done as described below.

Dispersions

The coupler dispersions used contained (w/w) 6.0% gelatin, 8.8% coupler, 1 molar equivalent of developer, and coupler solvents in the ratio coupler: tricresylphosphate: 2-(2-butoxyethoxy)ethyl acetate 1.0:0.5:1.5.

The dispersions were washed for 6 hours at 4° C.

Coatings

The coupler/developer dispersions were coated with a (green-sensitised) silver bromoiodide emulsion in the following format:

| | | |
|---|---|---|
| Gel supercoat | Gelatin | 1.5 $gm^{-2}$ |
| Emulsion Layer | Silver bromoiodide | 1.61 $gm^{-2}$ |
| | Coupler (+dev) | 1.04 mmol $m^{-2}$ |
| | Gelatin | 2.42 $gm^{-2}$ |
| | Bis(vinylsulphonyl)-methane (hardener) | 0.06 $gm^{-2}$ |
| Support | Cellulose Acetate | |

The coatings were slit and chopped into 12"×35 mm strips and exposed (0.1 sec, DL V+WR 9 filters) and processed through the following sequence, using an activator solution of the given composition:

| Processing Sequence | |
|---|---|
| Activator | 2.5 min |
| Wash | 1.0 min |
| Bleach | 4.0 min |
| Wash | 2.0 min |
| Fix | 4.0 min |
| Wash | 2.0 min |
| Base Dip | 1.0 min |
| Activator Solution | |
| $Na_2CO_3$ | 26.5 g/l |
| $NaHCO_3$ | 6.3 |
| $Na_2SO_3$ | 2.0 |
| NaBr | 1.0 |
| 4-hydroxymethyl-4-methyl-1-phenylpyrazolidin-3-one | 0.2 |
| Water to pH = 10.4 | 1.0 l |

The post-process base dip (pH 10.4 solution—$Na_2CO_3$ 26.5 g/l and $NaHCO_3$ 6.3 g/l) is required to obtain the full-coloured anionic form for the cyan azo dye.

The following Example is included for a better understanding of the invention.

EXAMPLE

A coating was made as described above using the Couplers identified below (with reference to Table 1 with developer D3 described above.

In the table of results below, $\gamma$ is the contrast, $D_{max}$ is the Status M red density, $\lambda_{max}$, $\lambda_{\frac{1}{2}}$, and HBW (Half Bandwidth) are in nm. $\lambda_{\frac{1}{2}}$ is measured at the mid point of a horizontal line drawn inside the absorption curve at the half band level and indicates the symmetry of the curve; the size of the difference between $\lambda_{max}$ and $\lambda_{\frac{1}{2}}$ indicates increasing asymmetry.

| Coupler | $\gamma$ | $D_{max}$ | $\lambda_{max}$ | $\lambda_{\frac{1}{2}}$ | HBW |
|---|---|---|---|---|---|
| C-1 | 1.75 | 2.17 | 648 | 625.5 | 107 |
| C-3 | 0.58 | 0.68 | 648 | 626 | 111.5 |
| C-4 | 1.11 | 1.43 | 648 | 626.5 | 96.5 |
| C-5 | 1.66 | 2.02 | 642 | 624 | 101 |
| C-8 | 0.57 | 0.72 | 650 | 620.5 | 134.5 |
| C-10 | 0.74 | 0.72 | 658 | 635.5 | 105.5 |

*denotes crystalline coating.

It can be seen from the table that couplers of the present invention provide useful cyan azo dye images when oxidatively coupled with quinazoline sulphonhydrazide developers. The results in terms of $D_{max}$ and wavelength of maximum absorption ($\lambda_{max}$) show that substituent Y of Formula (2) has little effect on the dye absorption curve but considerable effect on coupler activity.

We claim:

1. A method of forming a photographic colour image which comprises imagewise exposing a photographic silver halide colour material and processing it with an alkaline developer solution in the presence of a sulphonhydrazide developer and a heteroarylacetonitrile colour coupler thus forming a dye image by reaction of oxidised sulphonhydrazide developer and the colour coupler, the heteroarylacetonitrile colour coupler having the general formula:

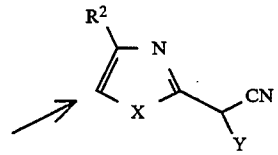

(2)

wherein $R^2$ is H or an alkyl or aryl group either of which may be substituted, X is —S—, —O— or —N($R^3$)— where $R^3$ is alkyl or aryl group either of which may be substituted, Y is an electron-withdrawing group having a Hammett sigma-para value greater than 0.3, and wherein the coupling position is indicated by the arrow.

2. A method as claimed in claim 1 in which the sulphonhydrazide developing agent has the general formula:

$$R—NHNH—SO_2—R^1 \quad (1)$$

wherein R is an aryl or heterocyclic group which may be substituted, and $R^1$ is an alkyl or aryl group, either of which may be substituted, and wherein R or $R^1$ contains a ballasting group of such size and configuration as to render the compound non-diffusible.

3. A method as claimed in claim 1 in which both the coupler and the developing agent are incorporated in the photogaphic material.

4. A method as claimed in claim 1 in which the coupler and the developing agent are incorporated in the photogaphic material in droplets of a high boiling coupler solvent.

5. A method as claimed in claim 4 in which both the coupler and the developing agent are co-dispersed in the same coupler solvent droplets.

6. A colour photographic material comprising at least two colour-forming units sensitive to different regions of the spectrum each comprising a silver halide emulsion layer characterised in that the material contains in or adjacent said layer, a ballasted photographic colour coupler and a ballasted sulphonhydrazide colour developing agent incorporated therein in droplets of a high boiling solvent and wherein the colour coupler is a heteroarylacetonitrile of the general formula (2) below, such that upon imagewise exposure of the material and processing of the element in an alkaline solution a dye image is formed by reaction of the oxidised suphonhydrazide developing agent and the colour coupler:

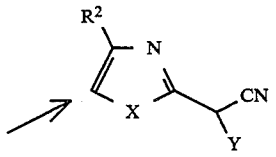

(2)

wherein $R^2$ is H or an alkyl or aryl group either of which may be substituted, X is —S—, —O— or —N($R^3$)— where $R^3$ is alkyl or aryl group either of which may be substituted, Y is an electron-withdrawing group having Hammett sigma-para value greater than 0.3, and wherein the coupling position is indicated by the arrow.

7. A colour photographic material as claimed in claim 6 wherein the sulphonhydrazide developing agent has the general formula (1) below:

$$R—NHNH—SO_2—R^1 \quad (1)$$

wherein R is an aryl or heterocyclic group which may be substituted, and $R^1$ is an alkyl or aryl group, either of which may be substituted, and wherein R or $R^1$ contains a ballasting group of such size and configuration as to render the compound non-diffusible.

8. A colour photographic material as claimed in claim 7 in which the material is a multicolour photographic material comprising a support bearing a yellow dye image-forming unit comprised of at least one blue-sensitive silver halide emulsion layer having associated therewith at least one yellow dye-forming coupler, at least one magenta dye image-forming unit comprising at least one green-sensitive silver halide emulsion layer having associated therewith at least one magenta dye-forming coupler at least one cyan dye image-forming unit comprising at least one red-sensitive silver halide emulsion layer having associated therewith at least one cyan dye-forming coupler.

9. A colour photographic material as claimed in claim 6 in which the material is a multicolour photographic material comprising a support bearing a yellow dye image-forming unit comprised of at least one blue-sensitive silver halide emulsion layer having associated therewith at least one yellow dye-forming coupler, at least one magenta dye image-forming unit comprising at least one green-sensitive silver halide emulsion layer having associated therewith at least one magenta dye-forming coupler at least one cyan dye image-forming unit comprising at least one red-sensitive silver halide emulsion layer having associated therewith at least one cyan dye-forming coupler.

10. A colour photographic material as claimed in claim 6 in which the material is a multicolour photographic material comprising a support bearing a yellow dye image-forming unit comprised of at least one blue-sensitive silver halide emulsion layer having associated therewith at least one yellow dye-forming coupler, at least one magenta dye image-forming unit comprising at least one green-sensitive silver halide emulsion layer having associated therewith at least one magenta dye-forming coupler at least one cyan dye image-forming unit comprising at least one red-sensitive silver halide emulsion layer having associated therewith at least one cyan dye-forming coupler.

* * * * *